US005374196A

United States Patent [19]

Horine

[11] Patent Number: 5,374,196

[45] Date of Patent: Dec. 20, 1994

[54] HIGH-DENSITY/LONG-VIA LAMINATED CONNECTOR

[75] Inventor: David A. Horine, Los Alto, Calif.

[73] Assignee: Fujitsu Limited, Kanagawa, Japan

[21] Appl. No.: 236,675

[22] Filed: May 2, 1994

Related U.S. Application Data

[63] Continuation of Ser. No. 957,712, Oct. 7, 1992, abandoned.

[51] Int. Cl.[5] ..... H01R 9/09

[52] U.S. Cl. ..... 439/65; 439/66; 439/91; 174/264

[58] Field of Search ..... 439/65, 66, 91, 74, 439/85; 29/830, 846; 174/250, 255, 262, 264; 361/412, 414

[56] References Cited

U.S. PATENT DOCUMENTS

| | | | |
|---|---|---|---|
| 3,528,174 | 9/1970 | Harrison . | |
| 3,680,037 | 7/1972 | Nellis et al. . | |
| 3,971,610 | 7/1976 | Buchoff et al. . | |
| 3,998,513 | 12/1976 | Kobayashi et al. . | |
| 4,199,637 | 4/1980 | Sado . | |
| 4,201,435 | 5/1980 | Nakamura et al. . | |
| 4,210,895 | 7/1980 | Sado et al. . | |
| 4,252,391 | 2/1981 | Sado . | |
| 4,252,990 | 2/1981 | Sado . | |
| 4,465,727 | 8/1984 | Fujita et al. | 439/85 |
| 4,663,831 | 5/1987 | Birretella et al. . | |
| 4,727,410 | 2/1988 | Higgins, III . | |
| 4,734,825 | 3/1988 | Peterson . | |
| 4,740,657 | 4/1988 | Tsukagoshi et al. . | |
| 4,770,640 | 9/1988 | Walter | 439/69 |
| 4,868,712 | 9/1989 | Woodman . | |
| 4,871,316 | 10/1989 | Herrell et al. | 439/66 |
| 4,928,061 | 5/1990 | Dampler et al. . | |
| 4,983,533 | 1/1991 | Go . | |
| 4,999,311 | 3/1991 | Dzarnoski, Jr. et al. . | |
| 5,006,916 | 4/1991 | Wills . | |
| 5,006,920 | 4/1991 | Schafer et al. . | |
| 5,012,047 | 4/1991 | Dohya | 174/250 |
| 5,026,290 | 6/1991 | Dery | 439/65 |
| 5,059,899 | 10/1991 | Farnworth et al. . | |
| 5,081,070 | 1/1992 | Yokoyama et al. | 174/250 |
| 5,136,471 | 8/1992 | Inasaka | 174/255 |
| 5,200,579 | 4/1993 | Takeuchi | 174/262 |

FOREIGN PATENT DOCUMENTS 0397057 4/1990 European Pat. Off. .

(List continued on next page.)

OTHER PUBLICATIONS

"Becon Connector", Disclosure Bulletin, Brown Engineering Company, Dec. 1961.

(List continued on next page.)

*Primary Examiner*—Mark Rosenbaum
*Assistant Examiner*—David P. Bryant
*Attorney, Agent, or Firm*—Christie, Parker & Hale

[57] ABSTRACT

A high-density laminated connector comprises a plurality of layers of rigid dielectric material which are laminated together. The rigid construction of the connector permits precise dimensions of the connecter and, thus, accurate attachment of adjacent circuit boards. The dielectric contains traces which are joined to contact pads, connecting the traces to adjacent circuit boards. The contact pads are comprised of soft gold, solder, and various elastomeric materials. The use of soft gold contacts allows the connector to be easily removed from the adjacent circuit board. Alternatively, the rigid dielectric layers contain recesses where the contact pads are placed. This ensures physical alignment of the circuit board and the connector, so that dimensional integrity is maintained when pressure is applied to the connector. The traces within the connector can be of a varied width, pitch, and direction. Thus, right-angle interconnections can be made. Cross-traces can be placed on each individual layer of dielectric or vias made through the dielectric layers, to interconnect traces. The trace width can be economically and accurately narrowed to produce high aspect ratios and thus provide high signal density.

17 Claims, 2 Drawing Sheets

FOREIGN PATENT DOCUMENTS

| | | | |
|---|---|---|---|
| 36355A1 | 6/1993 | Germany . | |
| 2041828 | 9/1980 | United Kingdom | 439/91 |
| WO8904113 | 5/1989 | WIPO . | |

OTHER PUBLICATIONS

"High Density Flexible Connector", IBM Technical Disclosure Bulletin, vol. 32, No. 7, Dec. 1989.

"Conductive Elastomeric Connector", Tecknit Disclosure Bulletin, Technical Wire Products, Inc., Jul. 1979.

European Patent Abstract, Publication No. JP62093961, Publication Date 1987.

Japanese Patent Abstract, Publication No. JP62093961, Publication Date 30 Apr. 1987, p. 1/1.

Japanese Patent Abstract, Publication No. JP63292504, Publication Date 29 Nov. 1988, p. 1/1.

Japanese Patent Abstract, Publication No. JP2012894, Publication Date 17 Jan. 1990, p. 1/1.

Japanese Patent Abstract, Publication No. JP2032595, Publication Date 2 Feb. 1990, p. 1/1.

Japanese Patent Abstract, Publication No. JP2091993, Publication Date 30 Mar. 1990, p. 1/1.

Japanese Patent Abstract, Publication No. JP4321258, Publication Date 11 Nov. 1992., p. 1/1.

Hermann Wessely, et al., "Electronic Packaging in the 1990's: The Perspective from Europe," *IEEE Transactions of Components, Hybrids, and Manufacturing Technology,* vol. 14, No. 2, Jun. 1991, pp. 272–284.

Victor J. Brzozowski, "Rigid and Flexible Printed Wiring Boards," *Rigid and Flexible printed Wiring Boards,* Chapter 8, pp. 8.1–8.66.

HIGH-DENSITY/LONG-VIA LAMINATED CONNECTOR

CROSS-REFERENCE TO RELATED APPLICATION

This is a continuation of application Ser. No. 07/957,712, filed Oct. 7, 1992, now abandoned.

BACKGROUND OF THE INVENTION

1. Field of the Invention

The present invention relates generally to the interconnection of electronic signals between multiple circuit boards. In particular, the present invention provides extreme signal density, right angle interconnection, and virtually-unlimited aspect ratios, and is rigidly constructed, maintaining dimensional integrity when force is applied.

2. Prior Art

In computer applications, numerous multi-chip modules (MCM) are interconnected using a connector. Since high-performance computers require many connections, precise tolerances of the connectors are required. Prior connectors used dielectrics which were not rigid enough to allow precise tolerances, such as a flexible rubber dielectric. The use of a flexible connector can result in incorrect placement of mating circuit boards. Also, prior designs which were not rigid failed to always keep dimensional integrity when forces were applied. Such forces result from thermal stresses or from employment of pressure contacts.

In certain prior-art systems, connection of a circuit board to a connector was accomplished by solder joints. The disadvantage of this method is that removal of the circuit board requires remelting of the contact joint.

The advent of high-performance computers creates a greater need for high-density connectors without an increase in the complexity or cost of manufacturing. A higher density of conductors can be achieved using a high aspect ratio. The thickness of a connector divided by the width or diameter of a trace defines the aspect ratio of the connector. A higher aspect ratio corresponds to a capacity for a higher density of conductors in the connector of a given height. Previously, traces through connector blocks were manufactured by processes such as punching, drilling, or molding. High aspect ratios were difficult to manufacture because the hole-forming tool was required to be relatively narrow and long. When the trace was formed, small deflections in the forming tool could cause the trace to curve, or the tool to break, thereby destroying the connector. Thus, the cost or difficulty of manufacturing put a limit on aspect ratios of prior designs. Typically, conventional connectors are limited to aspect ratios of approximately 20.

There is a need for connectors with precise dimensions, facilitating accurate placement of circuit boards. Additionally, a connector with a high aspect ratio without a complex or costly manufacturing process is desirable. It would be advantageous to have a connector which can employ various contact schemes, but particularly one which would permit easy configuration changes.

SUMMARY OF THE INVENTION

The present invention comprises a plurality of precisely formed layers of dielectric material, each with signal traces, which are laminated together to form a connector block. The traces can be of varied width and direction. In a first embodiment, the traces are precisely imaged on the lamination layer by silk screening with a metal paste. In a second embodiment, channels are etched in the dielectric, and a conductor is sputtered into the channel. Patterns for etching and sputtering are controlled with photolithographic techniques. The block is precision-cut along at least two different planes to expose ends of the traces. The traces are connected to a circuit board with the use of contacts comprising gold, solder, or a conductive elastomeric material. The contacts are positioned at trace terminals on the precision-cut surfaces, which may include all six sides of the hexahedral connector block.

Traces and cross-traces within the layers of the laminated connector block allow connection at four of the six sides, while vias transverse to the layers allow interconnection of traces in different layers and connection to the remaining two surfaces of the connector block.

The present invention incorporates a rigid dielectric material which permits precise tolerances and allows pressure contacts while maintaining dimensional integrity. Also, the dielectric in an alternative embodiment incorporates recesses at the terminals of the traces where the contact pads are placed. This ensures rigid mechanical connection between the connector and the circuit boards. The precise tolerances of the mating surfaces on the connector permit accurate placement of the circuit boards adjacent to the connector. Narrow traces can be formed on the individual layers which permits substantially-high aspect ratios.

DETAILED DESCRIPTION

Figure 1:
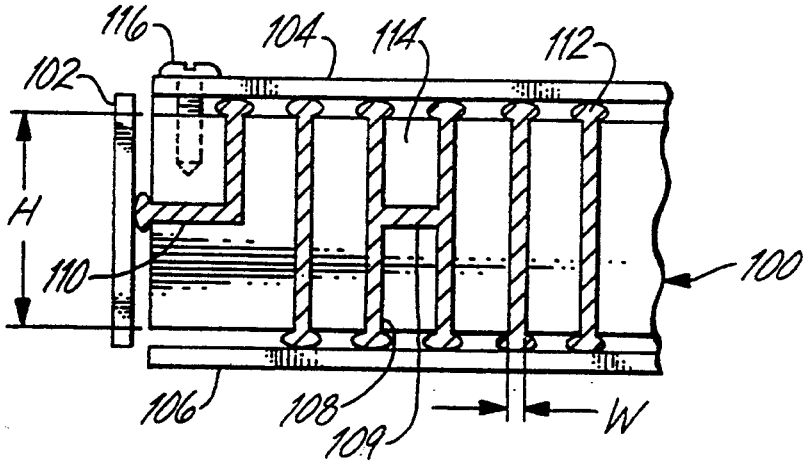
FIG. 1 is a partial side view of a connector attached to three circuit boards.

Referring to FIG. 1, the laminated connector 100 is attached to three circuit boards 102, 104, and 106 on each edge of the connector shown. The full length of the connector is not shown, so the right edge of the laminated connector is not visible. The laminated connector comprises a rigid dielectric material containing signal traces 108. The dielectric in a first embodiment comprises glass ceramic materials. In an alternative embodiment, borosilicate glass is used. The dielectric constant for glass ceramic in the present embodiments of the invention is less than 5.7, and for glass, less than 5, achieving a desired dielectric of less than 7.

The traces 108, as shown in FIG. 1, are parallel to each other and of uniform dimensions. However, the traces in alternative embodiments are positioned in a multitude of directions and can have varying dimensions. The signal trace 110, which is at a right angle to the other traces 108, demonstrates that the traces can be positioned in various locations. Thus, this invention allows both straight-through and right-angle interconnections.

The traces can be manufactured to a narrow width employing the present invention. In an exemplary embodiment, the trace width is 0.075 millimeter, which is narrower than the smallest widths achieved by drilling. Thus, a high aspect ratio (the height of the dielectric layer divided by the trace width) is achieved by applying the traces on the individual layers before laminating the layers together. In the present embodiment, an aspect ratio of 26 is achieved. However, the aspect ratio could be unlimited. In practical embodiments, aspect ratios in excess of 40 are feasible.

The signal traces 108, at their terminals, have contact pads 112. The contact pads 112, which are oval and wider than the signal traces, connect the laminated connector 100 to the circuits boards 102, 104, and 106. Intralayer connections between traces are accomplished with cross-traces 109. In the embodiment shown in the drawings, the contact pads comprise soft gold, where electrical contact is produced by applying pressure on the circuit board and the connector joint. In a present embodiment of the invention, the circuit board 104 is attached to the connector 100 with the use of a screw 116. By removing the screw 116, the pressure placed on the circuit board and the connector joint will be removed. The capability to easily remove the boards is useful where boards have to be rearranged or taken out for testing. In the alternative embodiments, the contacts of one or more face(s) of the connector comprise solder. The connector is electrically connected by solder to the first circuit board on the stack. Boards attached to additional faces employ mechanical or solder connections. Two different solder materials may be used to attach separate circuit boards to the connector block. This enables removal of one circuit board using one temperature to melt only one solder connection. These embodiments permit easy removal of one circuit board for testing or configuration changes while leaving intact the attachment of the connector block to the other circuit board.

Figure 2:
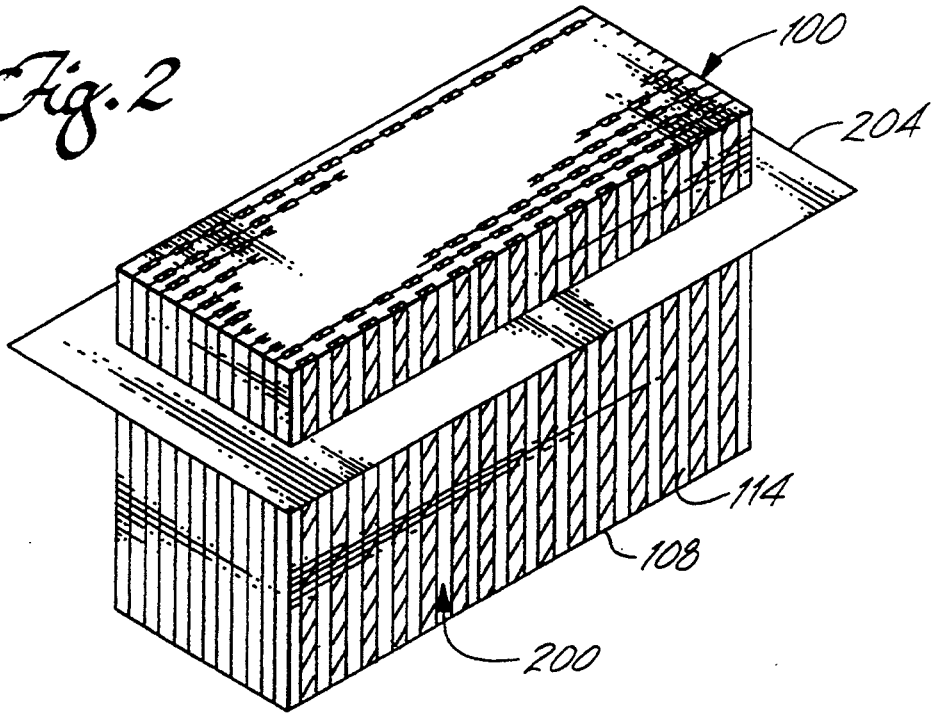
FIG. 2 is an elevation of a connector block before being cut into individual connectors.

FIG. 2 shows a connection block, employing the present invention, comprising planar layers of the rigid dielectric material 114. The rough laminated block 200 is manufactured by laminating together layers of green sheet. The green sheets are formed by wet-grinding fine-grained reactive oxides in ball mills which are also charged with deflocculents, binders, plasticizers, lubricants, grain growth inhibitors, and organic solvents. This slurry is spread on a carrier film of polyester. In an alternative embodiment, the slurry is spread on cellulose acetate. The film and slurry move at a constant speed under a metal knife so that a thin sheet of wet glass ceramic is formed. The glass ceramic sheet is air-dried to remove solvents and then cleaned to provide a smooth surface for printing purposes and to eliminate particles that would cause circuit interruptions.

The traces 108 are precisely formed by coating green sheets with copper paste or ink and are converted to conductors after firing of the green sheets. Resistor paste or other metals can also be applied to the layers of dielectric before or after firing.

The green sheets are then superimposed on each other and are adhered to each other by a hot isostatic press. Sufficient pressure is applied on the layers of green sheets to provide a unitary laminated block. The laminated block is then placed in a sintering oven for firing, at approximately 300° C. to 600° C., to remove organic binders, lubricants, plasticizers, and deflocculents. The green sheets are subsequently co-fired at higher temperatures of approximately 1000° C. in a nitrogen atmosphere. This causes simultaneous sintering of glass ceramic and copper metallization. Sintering causes the particles to become more dense so that the green sheets have good mechanical strength.

In alternative embodiments, the layers of dielectric in the block comprise glass, silicon, gallium arsenide, or quartz. Slabs of glass, which will comprise the layers of the connector block, are precision-ground and lapped to achieve desired tolerances for surface parallelism, flatness, and finish. A photoresist material is applied to the surface of the glass. In the present embodiment, only one surface of the glass is coated; however, in alternative embodiments of the invention, both surfaces of the dielectric may be coated and processed, as discussed subsequently, for added signal density.

The photoresist is cured, traces are imaged, and photoresist is developed to create a pattern for etching of the glass dielectric using standard photolithographic techniques. Grooves are then etched in the dielectric corresponding to the imaged traces using hydrofluoric acid or other appropriate etchant.

After etching, the photoresist from the trace-imaging process is stripped, providing a clean surface on the dielectric. Metal for the traces is then plated or sputtered onto the dielectric, and subsequent photolithographic processing and etching of the plated dielectric are then accomplished to create metal-filled grooves in the glass layer. The dielectric layers are precisely aligned and bonded to form the connector block, as shown in FIG. 2. In the preferred embodiment, diffusion bonding is employed. A combination of heat and pressure applied to the stacked layers, results in diffusion of molecules between adjacent layers of the glass, effectively welding together the layers. Exemplary diffusion bonding processes for silicon dielectrics provide for conditioning of the surface with sulfuric peroxide with application of pressure while heating the laminate to 500° C. to 600° C. Standard adhesives may be used in alternate embodiments where dimensional control may be relaxed, allowing for thickness variation in the bond layer.

The connector is cut from the block to precise dimensions by precision-sawing the laminated block and then polishing and lapping the surfaces of the connector. The connector block is cut along a horizontal plane 204, exposing traces 108 of the laminated connector 100. The use of the rigid dielectric material permits the individual layers of dielectric material and the laminated connector 100 to be cut and lapped to very precise dimensions using existing processes. Tolerances on the order of $\frac{1}{4}$ wavelength of light can be obtained. In a present embodiment, the connector is approximately two millimeters high. The individual layers are approximately 0.16 millimeter thick.

Figure 3:
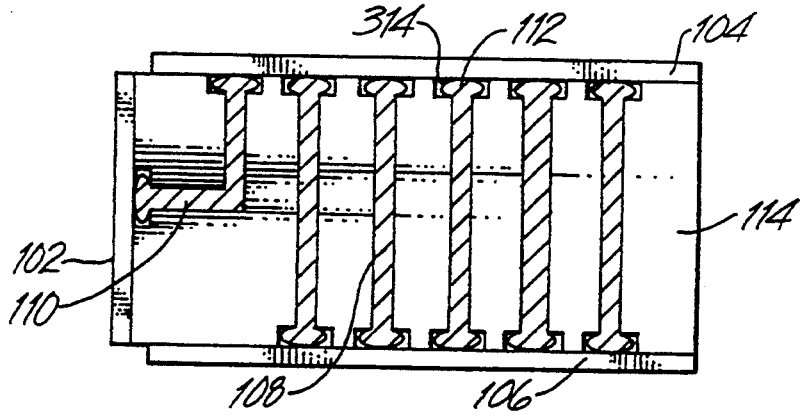
FIG. 3 is a second embodiment of the present invention and a partial side view of a connector, demonstrating connection to adjacent circuit boards

FIG. 3 shows a second embodiment of the invention wherein contact pads 112 are recessed in the dielectric material 114. Mating surfaces surrounding the recesses are precision-machined to achieve high tolerances in the connection. The dielectric material 114 contains cylindrical recesses 314, where the contact pads 112 are placed. The circuit board 104 is mounted onto the connector with a screw, which urges the circuit board into contact with the connector, compressing the contact pads 112. The screw extends into a tapped hole in the connector through an aperture in the circuit board, as shown in FIG. 1. Alternate mechanical attachment means can also be employed. Precise controls on the depth of the recesses restrict the amount of compression of the contact pads. Consequently, there is a rigid mechanical connection between the circuit boards and the connector, and, therefore, dimensional integrity will be maintained when thermal stresses occur. Precision-machining of the recesses assures that the compression on the contact pads stays within the elastic limit, providing more reliable and resilient contact pads.

Figure 4:
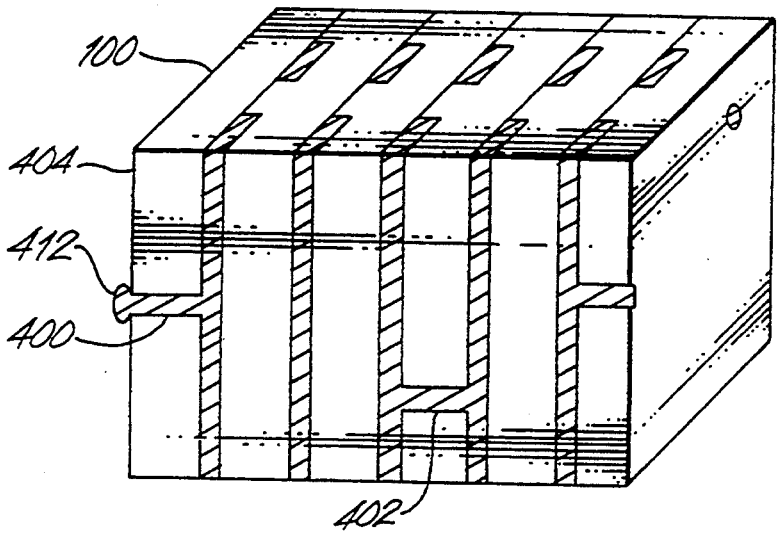
FIG. 4 is a perspective view of the connector block with vias interconnecting traces.

FIG. 4 shows a via 402 extending between layers of the connector which interconnects two traces 108. The via is a connection which shorts two traces or extends from one trace to the external edge 404 of the connector 100. An external via 400 extends through an end layer and is joined to a contact pad 412 which will interface with a circuit board. The vias are orthogonal to the traces as shown in FIG. 4; however, they may be placed at different locations and at various angles. In the embodiment using glass, the vias are manufactured by laser-drilling a hole and then plating and sputtering metal into the hole. In the second embodiment, using green sheets, the vias are manufactured by such processes as laser-cutting, punching, or drilling a hole, and then pasting the conductive material through the hole during the prelamination processing previously described.

As demonstrated in FIG. 3, the traces within each layer of the laminated connector allow terminations at four surfaces of the connector block. The vias, as demonstrated in FIG. 4, further enhance the present invention over prior-art connectors, providing for connection between traces in adjacent layers of the connector and connection to the surfaces of the connector block parallel to the laminated layers. Embodiments of the invention may therefore be employed to interconnect up to six MCM boards.

The present embodiments of this invention are to be considered in all respects as illustrative and not restrictive; the scope of the invention to be indicated by the appended claims rather than the foregoing description. The invention can be practiced in many different embodiments and variations. For example, additional spacing layers could be silk-screened or glued to the surface of the dielectric to precisely place the circuit boards adjacent the connector. A variety of methods for contact pad can be employed, including fuzz buttons, screws, or springs. All changes which come within the meaning and range of equivalency of the claims are intended to be incorporated within the scope of this invention.

What is claimed is:

1. A connector comprising:

a plurality of planar layers of a rigid dielectric material, said layers laminated to form a block;

at least one trace on each planar layer of dielectric material having an exposed terminal on a first surface of the connector, said exposed terminal including a contact pad adapted for interconnection with a circuit board; and means for interconnection of at least two of the traces within the block.

2. A connector as defined in claim 1 further including:

means for removably attaching a circuit board to the connector for electric contact with at least one contact pad.

3. A connector as defined in claim 1 wherein the rigid dielectric has a dielectric constant of less than seven.

4. A connector as defined in claim 1 further comprising a plurality of traces on each planar layer.

5. A connector as defined in claim 4 wherein the traces have varying pitch and width.

6. A connector as defined in claim 5 wherein the width of the traces provides the connector with an aspect ratio greater than 40.

7. A connector as defined in claim 4 wherein the interconnection means comprises a via extending between the planar layers of the dielectric.

8. A connector as defined in claim 4 wherein the interconnection means comprises a cross-trace on at least one planar layer of dielectric material.

9. A connector as defined in claim 4 wherein at least one of said plurality of traces has a second exposed terminal on a second surface of the connector perpendicular to said first surface.

10. A connector as defined in claim 9 wherein at least one of said plurality of traces connects to a via which has a third terminal on a third surface of the connector which is perpendicular to said first and said second surfaces.

11. A connector as defined in claim 4 wherein a cross-trace extends between one of said plurality of traces and a second surface of the connector which is perpendicular to the first surface of the connector.

12. A connector as defined in claim 11 wherein a via extends between one of said plurality of traces and a third surface of the connector which is perpendicular to said first surface and said second surface of the connector.

13. A connector as defined in claim 4 wherein the traces are photolithographically imaged on the layers.

14. A connector as defined in claim 4 wherein the traces are printed on the layers.

15. A connector as defined in claim 1 wherein the contact pad comprises soft gold.

16. A connector as defined in claim 1 wherein the contact pad comprises a conductive elastomeric material.

17. A connector as defined in claim 1 wherein the contact pad comprises solder.

* * * * *

UNITED STATES PATENT AND TRADEMARK OFFICE

CERTIFICATE OF CORRECTION

PATENT NO. : 5,374,196

DATED : December 20, 1994

INVENTOR(S) : David A. Horine

It is certified that error appears in the above-indentified patent and that said Letters Patent is hereby corrected as shown below:

On the Title Page, [56] References Cited, FOREIGN PATENT DOCUMENTS, page 1,
change "0397057 4/1990 European Pat. Off"
to -- 0397057 11/1990 European Pat. Off --

On the Title Page, [56] References Cited, FOREIGN PATENT DOCUMENTS, page 2,
change "36355A1 6/1993 Germany"
to -- 4136355A1 5/1993 Germany --.

Column 2, line 41, after "boards" insert -- using a dielectric block with stop surfaces; and --.

Column 3, line 13, change "circuits" to -- circuit --.

Signed and Sealed this

Twenty-ninth Day of August, 1995

*Attest:*

BRUCE LEHMAN

*Attesting Officer*

*Commissioner of Patents and Trademarks*